US007069677B2

(12) United States Patent
Chang

(10) Patent No.: US 7,069,677 B2
(45) Date of Patent: Jul. 4, 2006

(54) METHOD FOR PRODUCING A READY-MIX SOIL MATERIAL

(75) Inventor: Cheng-Feng Chang, No. 104-1, Cheng-Kung Rd., Ting-Liao Tsun, Lu-Chu Hsiang, Kaohsiung Hsien (TW)

(73) Assignee: Cheng-Feng Chang, Kaohsiung Hsien (TW)

( * ) Notice: Subject to any disclaimer, the term of this patent is extended or adjusted under 35 U.S.C. 154(b) by 104 days.

(21) Appl. No.: 10/680,958

(22) Filed: Oct. 7, 2003

(65) Prior Publication Data

US 2005/0077058 A1 Apr. 14, 2005

(51) Int. Cl.
*E02F 3/00* (2006.01)

(52) U.S. Cl. ..... 37/466; 241/101.74; 404/90; 404/92

(58) Field of Classification Search ..... 404/76, 404/83, 90, 91, 92; 241/101.74; 37/142.5, 37/403, 461, 466; 405/258, 263, 269, 303
See application file for complete search history.

(56) References Cited

U.S. PATENT DOCUMENTS

| | | | | |
|---|---|---|---|---|
| 4,106,296 | A * | 8/1978 | Leonard et al. | 405/264 |
| 4,367,986 | A * | 1/1983 | Miyoshi et al. | 588/257 |
| 4,443,260 | A * | 4/1984 | Miyoshi et al. | 106/715 |
| 5,248,327 | A * | 9/1993 | Laker et al. | 71/24 |
| 5,975,441 | A * | 11/1999 | Burkholder | 241/24.12 |
| 6,000,641 | A * | 12/1999 | Komoriya et al. | 241/29 |
| 6,079,647 | A * | 6/2000 | Leduc et al. | 241/73 |
| 6,171,030 | B1 * | 1/2001 | Miyake et al. | 405/258.1 |
| 6,183,159 | B1 * | 2/2001 | Hashimoto et al. | 404/76 |

* cited by examiner

*Primary Examiner*—Victor Batson
(74) *Attorney, Agent, or Firm*—DLA Piper Rudnick Gray Cary US LLP

(57) ABSTRACT

A method for producing a ready-mix soil material includes the steps of: (a) crushing earth material excavated from a work site; (b) sieving the earth material after crushing so as to obtain raw soil material; and (c) mixing metered amounts of the raw soil material and at least one strength-enhancing additive in an automated manner so as to obtain the ready-mix soil material.

16 Claims, 6 Drawing Sheets

METHOD FOR PRODUCING A READY-MIX SOIL MATERIAL

BACKGROUND OF THE INVENTION

1. Field of the Invention

The invention relates to a method for producing a ready-mix soil material, more particularly to a method for producing a ready-mix soil material from earth materials excavated from work sites.

2. Description of the Related Art

In conventional construction work, such as piping work, road maintenance, and the like, a work site for the construction work is dug and refilled at the beginning and end of the construction work, respectively. Earth material resulting from the digging of the work site is usually discarded as waste. In view of bearing strength and shearing strength consideration, it is required to refill the work site with additional soil material, which is usually sand-gravel obtained by digging of river-beds, at the end of the construction work.

However, the aforesaid conventional method for construction work has the following shortcomings:

(1) Discarding of the earth material as waste and obtaining additional soil material by digging of river-beds can result in a severe adverse impact on the environment.

(2) When the additional soil material obtained by the digging of river-beds is used for refilling material, it is required to repeat tamping operations a number of times. However, in practice, it is difficult to conduct the tamping operations precisely. Therefore, defects such as depressions, holes and the like can easily form in the refilled work site.

(3) If concrete is used as the refilling material for the work site, the defects associated with the tamping operations may be avoided in view of the relatively high strength characteristics of concrete. However, the use of concrete as the refilling material is relatively costly. Furthermore, it is relatively difficult to dig the work site refilled with concrete when necessary.

SUMMARY OF THE INVENTION

Therefore, the object of the present invention is to provide a method for producing a ready-mix soil material from earth material obtained from a work site so as to overcome the aforesaid shortcomings.

According to one aspect, the method for producing a ready-mix soil material according to this invention includes the steps of: (a) crushing earth material excavated from a work site; (b) sieving the earth material after crushing so as to obtain raw soil material; and (c) mixing metered amounts of the raw soil material and at least one strength-enhancing additive in an automated manner so as to obtain the ready-mix soil material.

According to another aspect, the method for producing a ready-mix soil material according to this invention includes the steps of: (a) crushing earth materials excavated from different work sites; (b) sieving the earth materials after crushing so as to obtain different raw soil materials; (c) mixing the raw soil materials to obtain a mixed soil material having desired clay, sand and gravel contents; and (d) mixing metered amounts of the mixed soil material and at least one strength-enhancing additive in an automated manner so as to obtain the ready-mix soil material.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
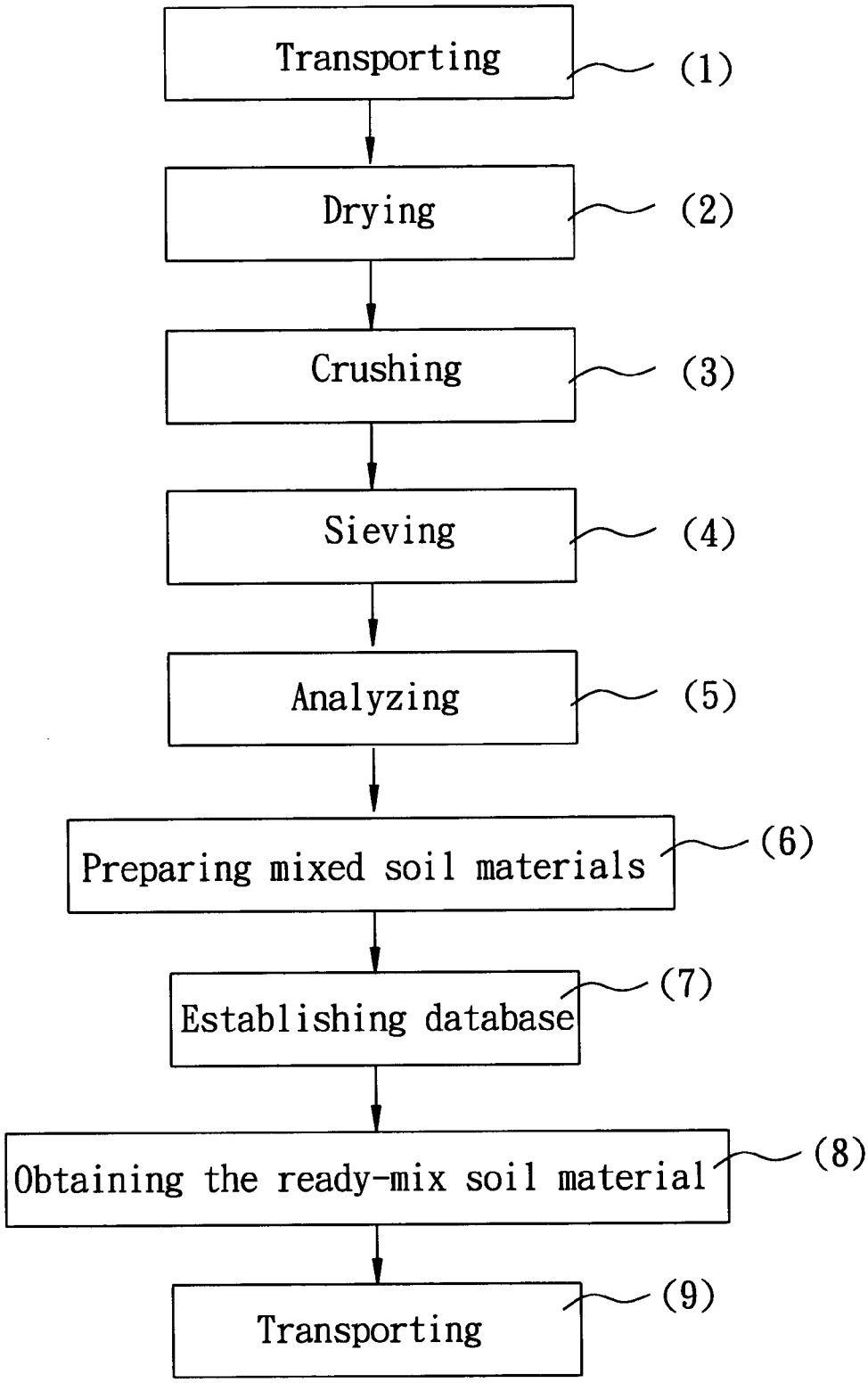
FIG. 1 is a flow diagram of the preferred embodiment of a method for producing a ready-mix soil material according to this invention.

Referring to FIG. 1, the preferred embodiment of the method for producing a ready-mix soil material according to this invention is shown to include the following steps:

(1) Transporting:

Earth materials excavated from different work sites are transported from each work site to a processing site. While three work sites (A), (B), (C) are illustrated in the preferred embodiment, the method of the present invention is useful for processing the earth materials excavated from a fewer or larger number of the work sites. It should be noted that the earth material containing an undesired high content of organic material is not suitable for processing in the method of the present invention, and should thus be discarded properly.

(2) Drying:

The earth materials transported to the processing site are subjected to a drying treatment. In the preferred embodiment, the drying treatment is conducted by exposing the earth materials to sunlight. However, other suitable means for the drying treatment can be employed in the method of the present invention.

(3) Crushing:

The dehydrated earth materials from the different work sites are subsequently crushed by using a suitable means, such as by using a pulverizer.

(4) Sieving:

The crushed earth materials from the different work sites are then sieved so as to remove particles having dimensions larger than 5 cm from the earth materials and to obtain different raw soil materials, i.e., raw soil materials (a), (b), (c).

(5) Analyzing:

Samples of the raw soil materials (a), (b), (c) are analyzed respectively in terms of the clay, sand and gravel convents thereof. The results of the analysis of the raw soil materials (a), (b), (c) in the preferred embodiment are shown in Table 1.

TABLE 1

| Raw soil material | Clay content (wt %) | sand content (wt %) | gravel content (wt %) |
|---|---|---|---|
| A | 10 | 80 | 10 |
| B | 45 | 50 | 5 |
| C | 80 | 18 | 2 |

(6) Preparing Mixed Soil Materials:

The raw soil materials (a), (b), (c) are mixed together to obtain different mixed soil materials, each of which has desired clay, sand and gravel contents. In the preferred embodiment, three mixed soil materials (i.e., mixed soil material (A'), (B'), (C')) are prepared. However, the number of the mixed soil materials that can be actually prepared in the method of the present invention should not be limited thereto. The clay, sand and gravel contents of each of the mixed soil materials used in the preferred embodiment are shown in Table 2.

TABLE 2

| Mixed soil material | clay content (wt %) | sand content (wt %) | gravel content (wt %) |
|---|---|---|---|
| A' | 60 ± 5 | 40 ± 5 | 0–5 |
| B' | 40 ± 5 | 60 ± 5 | 0–5 |
| C' | 20 ± 5 | 80 ± 5 | 0–1 |

Since the gravel content is much lower than the clay and sand contents in each of the raw soil materials, the gravel content can be omitted in the calculation for the preparation of the mixed soil materials.

The procedure for preparing the mixed soil material (A') is illustrated in the following:

(6-1) Choosing Proper Raw Soil Materials:

Since the mixed soil material (A') contains about 60 wt % of clay and about 40 wt % of sand, the raw soil material (a) containing a relatively high sand content is not used for the preparation of the mixed soil material (A'). Therefore, the raw soil materials (b), (c) are chosen for the preparation of the mixed soil material A'.

(6-2) Calculations:

If one ton of the mixed soil material (A') is prepared by mixing x ton of the raw soil material (b) and y ton of the raw soil material (c), then the clay content of the mixed soil material (A') (i.e., about 0.6 ton) is equal to the total clay contents of the raw soil materials (b), (c) (i.e., 0.45*x+0.8*y), and the sand content of the mixed soil material (A') (i.e., about 0.4 ton) is equal to the total sand contents of the raw soil materials (b), (c) (i.e., 0.5*x+0.18*y) The following two equations are established:

$$0.45x+0.8y=0.6$$

$$0.5x+0.18y=0.4$$

The percentages (i.e., the values x, y) of the raw soil materials (b), (c) for the preparation of the mixed soil material (A') can be obtained to be 65 wt %, and 37 wt %, respectively. The mixed soil materials (B'), (C') can be prepared in a similar manner according to the aforesaid procedure.

Optionally, an additive soil material having a high sand content (for example, above 90 wt %) and/or an additive soil material having a high clay content (for example, above 90 wt %) can be used when preparing the mixed soil materials.

Figure 2:
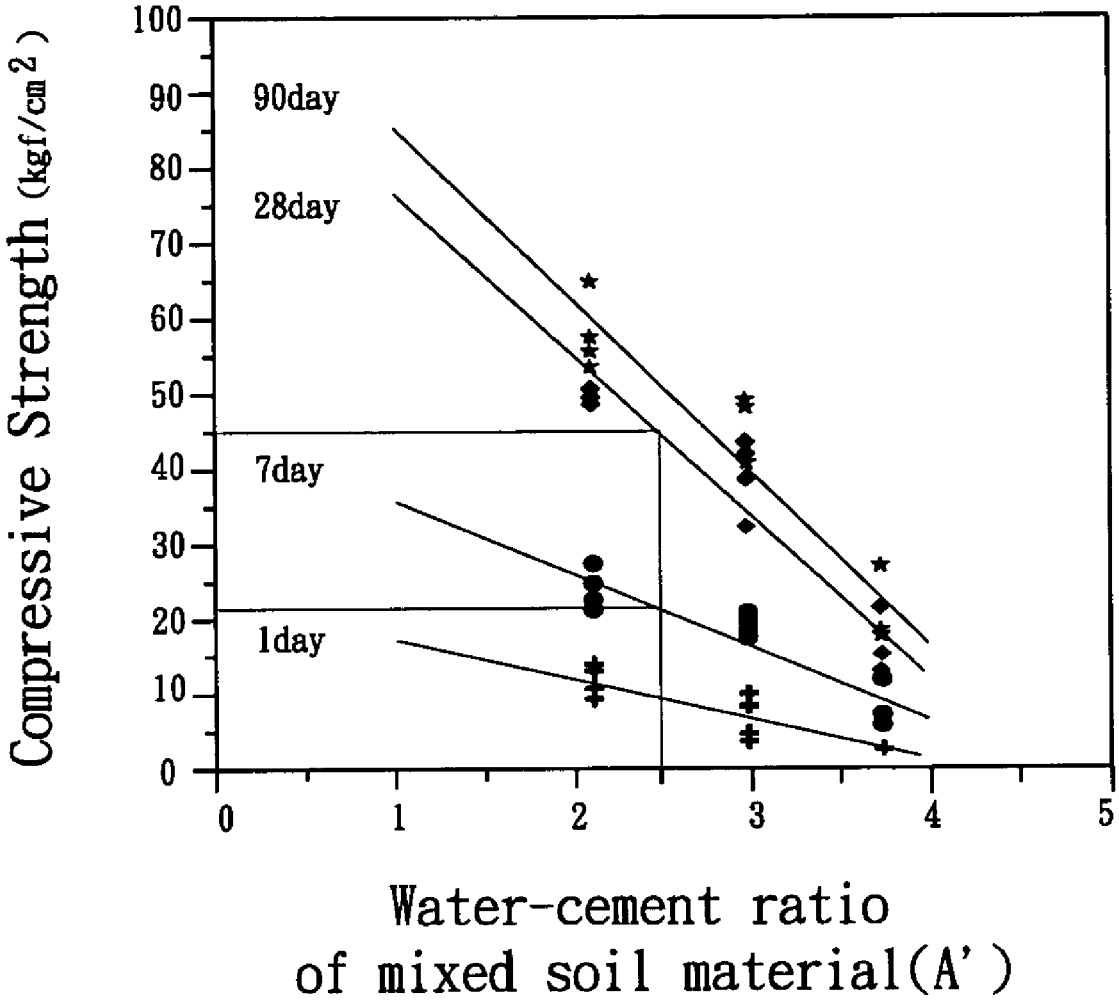
FIGS. 2 and 4 are diagrams, each of which shows a relationship of compressive strength of a mixed soil material used in the preferred embodiment versus a water-cement ratio.
Figure 3:
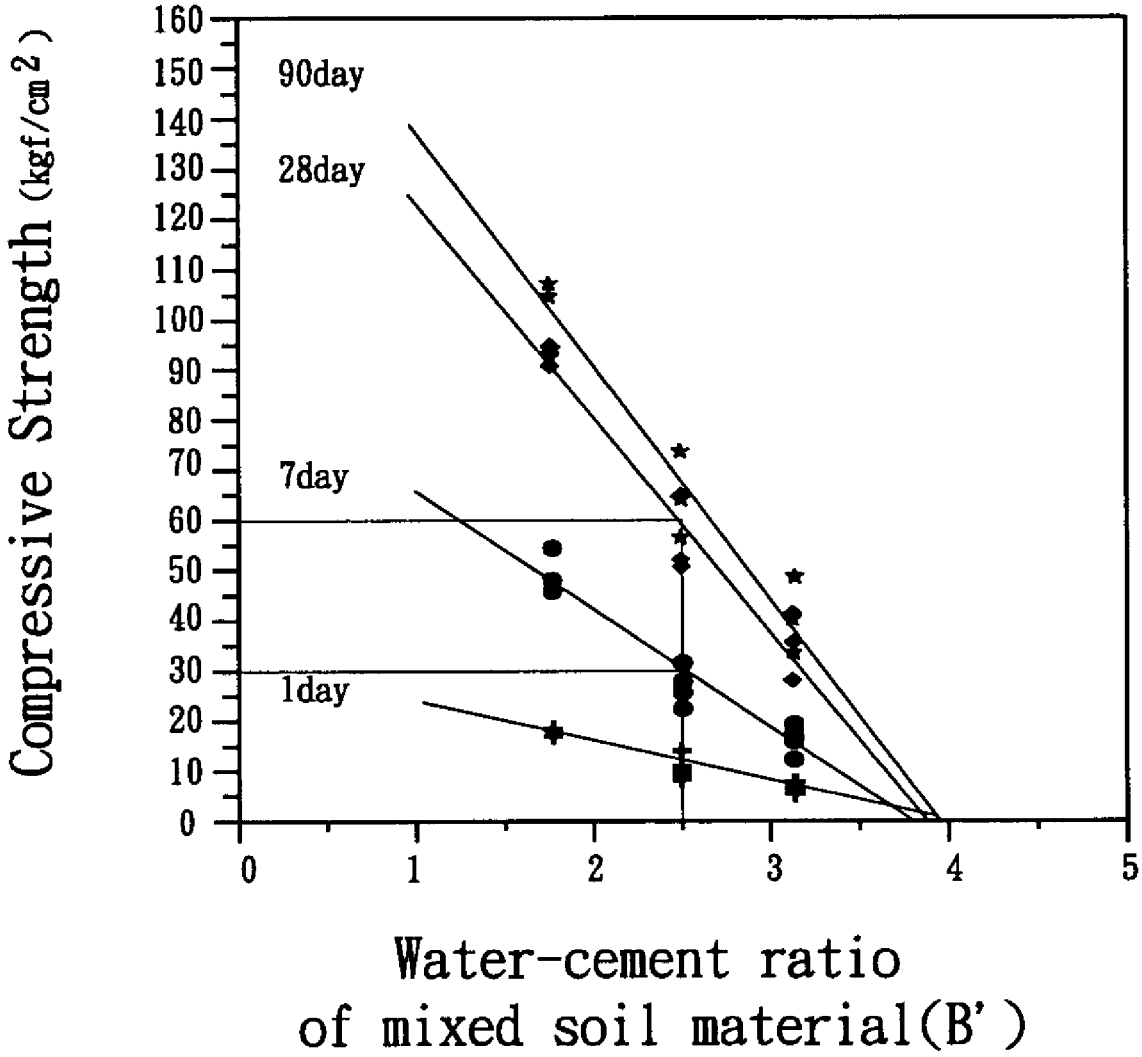
Figure 4:
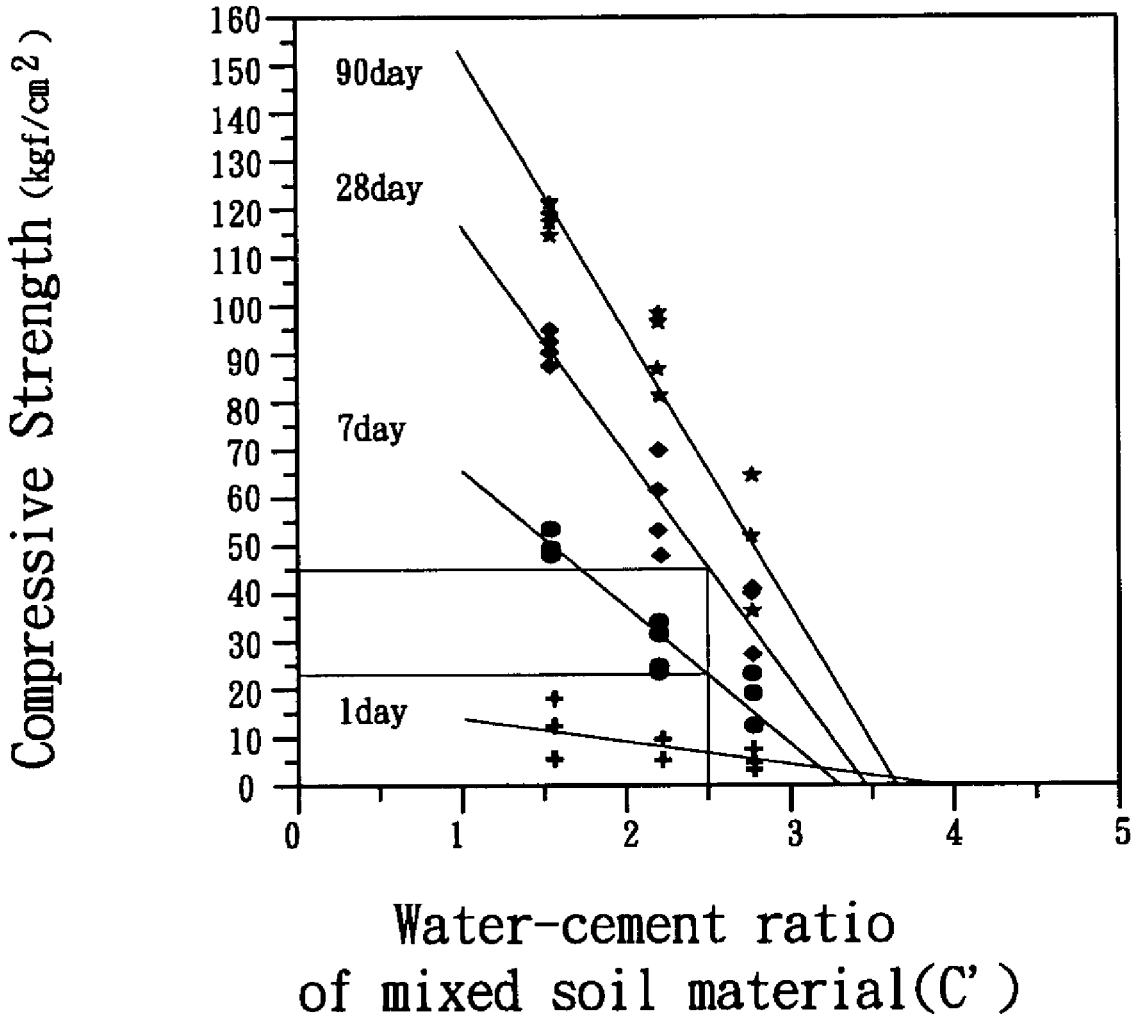

(7) Establishing Database:

Ready-mix soil material formulations having different mechanical properties are prepared by varying amounts of each of the mixed soil materials (A') (B'), (C') and at least one strength-enhancing additive. A database for the ready-mix soil material formulations versus the mechanical properties can be established. Referring to FIGS. 2 to 4, a relationship of compressive strength of each of the mixed soil materials (A'), (B'), (C') versus a water-cement ratio is established in the database. The strength-enhancing additive used in the preferred embodiment can be a solidifying agent, a cementing agent, a water-reducing agent, an early-strength agent, and the like.

(8) Obtaining the Ready-Mix Soil Material:

According to customer's requirements, a metered amount of the chosen mixed soil material is mixed with a metered amount of the strength-enhancing additive together with a suitable amount of water in an automated manner so as to obtain the ready-mix soil material. The metered amounts of the mixed soil material and the strength-enhancing additive are determined with reference to the database.

(9) Transporting:

The read-mix soil material thus obtained is finally transported by vehicle, such as a concrete mixer, to a work site.

In view of the requirements of road refilling, a compressive strength of 3.5 kgf/cm$^2$ and above is sufficient for the refilled road after tamping to meet the bearing and shearing strength requirements. As shown in FIGS. 2 to 4, since the mixed soil materials formulated according to the present method have the compressive strength much larger than 3.5 kgf/cm$^2$, the ready-mix soil material produced therefrom can have the required strength.

In view of the aforesaid, the shortcomings encountered in the prior art can be overcome by the method of the present invention, which utilizes the earth material typically discarded in the prior art. Additionally, since the particles having relatively large dimensions are removed by sieving, the risk of machine failure can be reduced, and the mixed soil material can be mixed with the strength-enhancing additive sufficiently so as to produce the ready-mix soil material having the required strength. Furthermore, since the method of the present invention establishes the database for the ready-mix soil material formulations and involves automated mixing of metered amounts of the mixed soil material and the strength-enhancing additive, the cost for the construction work can be reduced.

Figure 5:
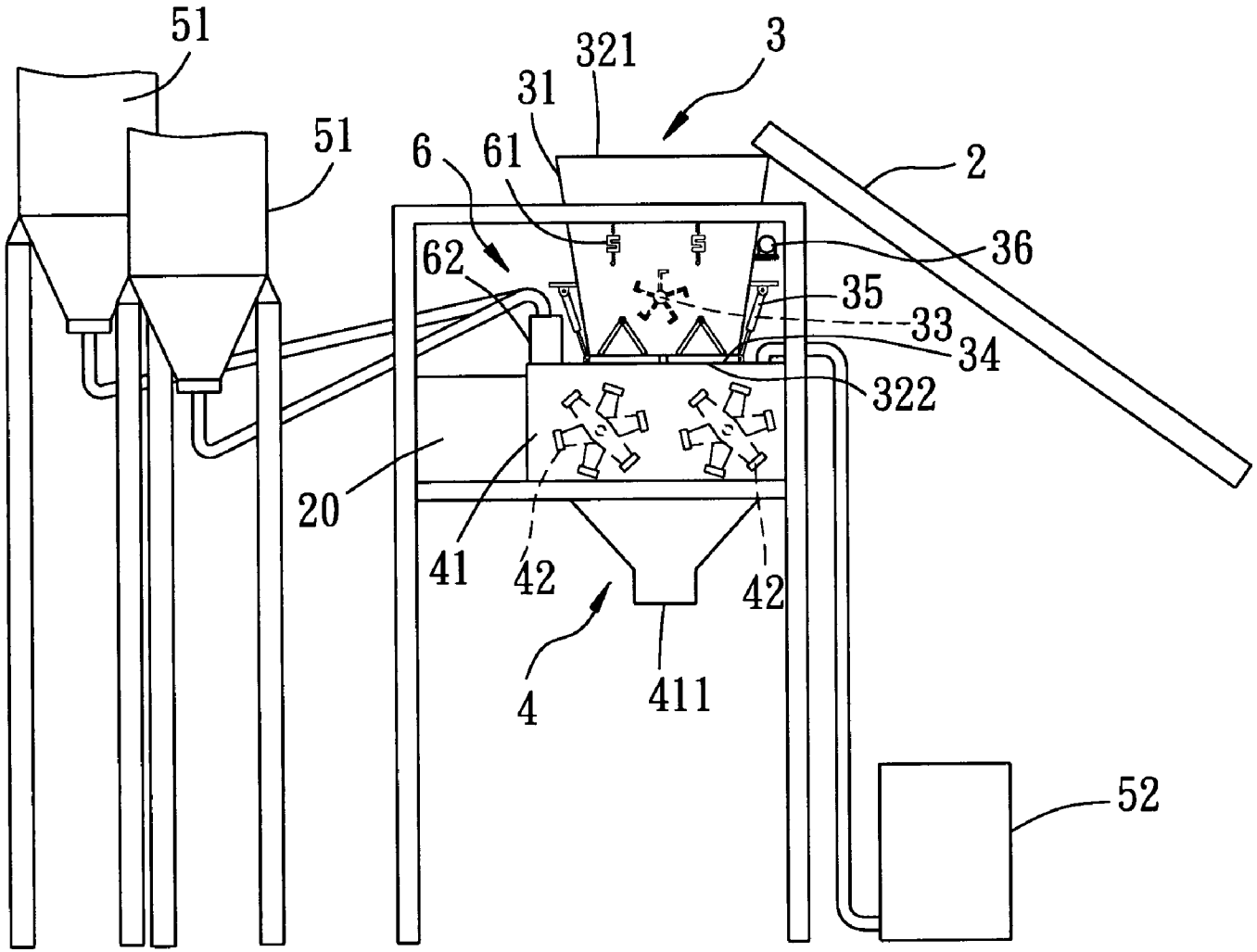
FIG. 5 is a schematic view showing a mixing device used in the method of the preferred embodiment.
Figure 6:
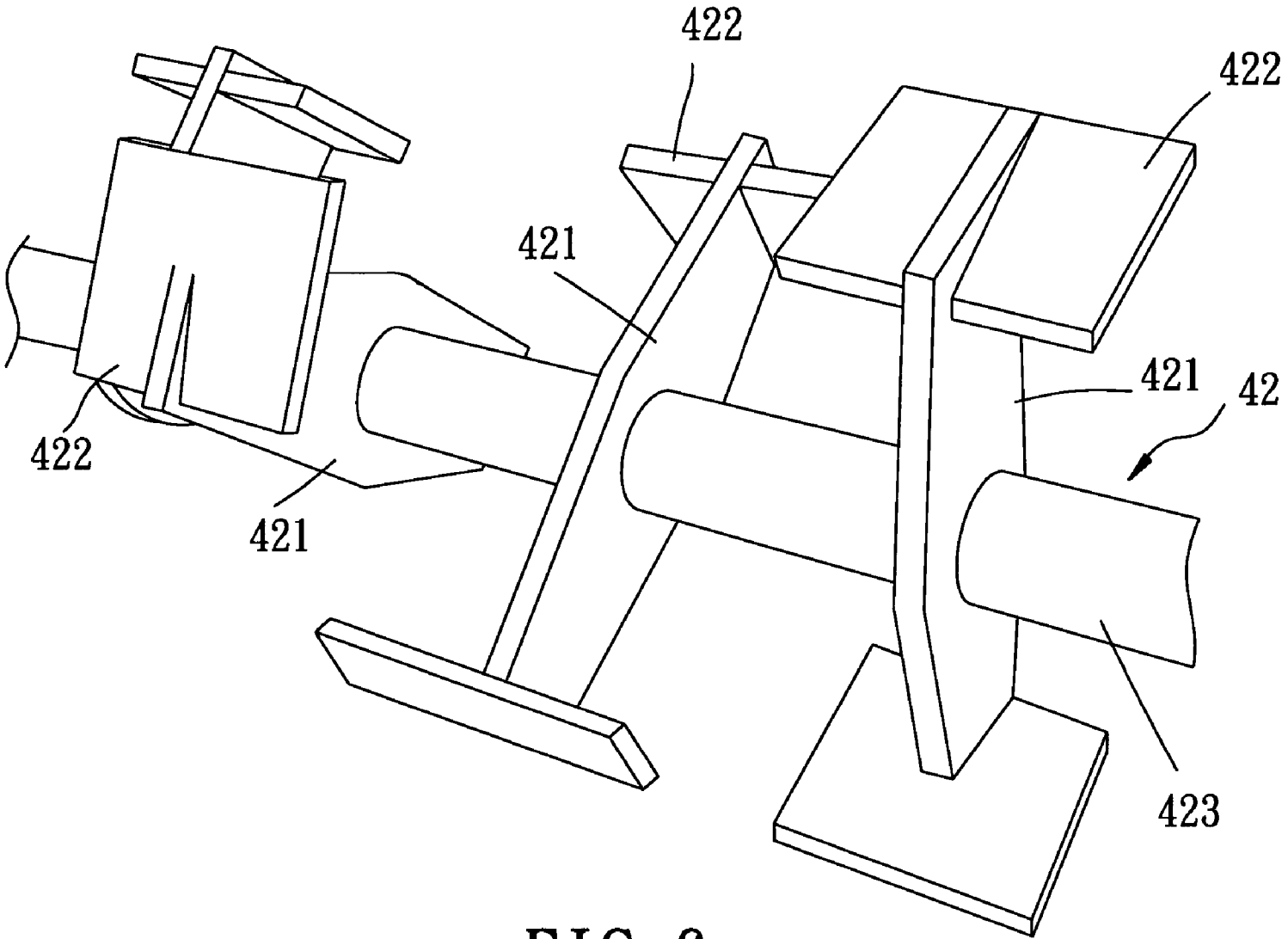
FIG. 6 is a fragmentary perspective view of a mixing unit provided in the mixing device.

Referring to FIGS. 5 and 6, a preferred embodiment of a mixing device for mixing metered amounts of the mixed soil material and the strength-enhancing additive in an automated manner to obtain the ready-mix soil material is shown to include a stirring tank 4, a feeding tank 3, two additive storage tanks 51, a conveying belt 2, a water storage tank 52, a metering assembly 6, and a control chamber 20.

The stirring tank 4 includes a tank body 41 for receiving the metered amounts of the mixed soil material and the strength-enhancing additive and a suitable amount of water therein, two stirring units 42 mounted in the tank body 41, and a bottom discharging exit 411. The bottom discharging exit 411 has a control gate (not shown) which is opened for discharging the ready-mix soil material so-produced to the concrete mixer. Each of the stirring units 42 has a rotary shaft 423, and a plurality of radial main blades 421 mounted radially on the rotary shaft 423. Each of the radial main blades 421 is provided with two opposite transverse blades 422 transverse to the main blade 421 at the edges thereof. Using two stirring units 42 can enhance the mixing of the metered amounts of the mixed soil material and the strength-enhancing additive with water.

The feeding tank 3 is mounted above the stirring tank 4, and includes a main tank body 31, a top feed opening 321, a bottom exit 322 for communicating the main tank body 31 of the feeding tank 3 with the tank body 41 of the stirring tank 4, an assist rotary discharging unit 33 mounted above the bottom exit 322, an exit gate 34 provided at the bottom exit 322, a control bar 35 for controlling the opening and closing of the bottom exit 322, and a vibrating motor 36 mounted outside the main tank body 31. The main tank body 31 of the feeding tank 3 has a tank wall inclined relative to a horizontal axis of the feeding tank 3 at an inclined angle ranging from 75° to 90° so as to minimize adhering of the mixed soil material on the inner wall of the main tank body 31. The assist rotary discharging unit 33 has a rotary shaft and a plurality of blades mounted radially on the rotary shaft.

The additive storage tanks 51 are used for storing the strength-enhancing additives. The metering assembly 6 includes a mixed soil material metering unit 61 mounted in the feeding tank 3 for metering the amount of the mixed soil material within the feeding tank 3, and a strength-enhancing additive metering unit 62 mounted at an exit of the additive storage tanks 51.

The conveying belt 2 is used to transport the mixed soil material into the feeding tank 3 via the top feed opening 321. When a desired amount of the mixed soil material is detected by the mixed soil material metering unit 61, the conveying belt 2 can be operated to stop the transporting of the mixed soil material, and the bottom exit 322 of the feeding tank 3 is opened so as to discharge the metered amount of the mixed soil material into the stirring tank 4 for the subsequent mixing with the additives.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A method for producing a ready-mix soil material, comprising the steps of:

(a) crushing earth material excavated from a work site;

(b) sieving the earth material after crushing so as to obtain raw soil material; and (c) mixing metered amounts of the raw soil material and at least one strength-enhancing additive in an automated manner so as to obtain the ready-mix soil material, wherein the method further includes, prior to step (c), analyzing samples of the raw soil material in terms of clay, sand, and gravel contents, with reference to results of analysis of the samples, preparing ready-mix soil material formulations having different mechanical properties by varying amounts of the raw soil material and said at least one strength-enhancing additive, and establishing a database for the ready-mix soil material formulations.

2. The method as claimed in claim 1, wherein the metered amounts in step (c) are determined with reference to the database.

3. The method as claimed in claim 1, wherein, in step (c), the raw soil material is optionally further mixed with at least one of an additive soil material having a high sand content, and an additive soil material having a high clay content.

4. The method as claimed in claim 1, wherein crushing of the earth material in step (a) is conducted alter subjecting the earth material to a drying treatment.

5. The method as claimed in claim 4, wherein the drying treatment includes exposing the earth material to sunlight.

6. The method as claimed in claim 1, wherein, in step (c), the raw soil material is optionally further mixed with a suitable amount of water.

7. The method as claimed in claim 1, wherein, in step (b), particles having dimensions larger than 5 cm are removed front the earth material to result in the raw soil material.

8. The method as claimed in claim 1, wherein the strength-enhancing additive used in step (c) is selected from the group consisting of a solidifying agent, a cementing agent, a water-reducing agent, and an early-strength agent.

9. A method for producing a ready-mix soil material, comprising the steps of:

(a) crushing earth materials excavated from different work sites;

(b) sieving the earth materials after crushing so as to obtain different raw soil materials;

(c) mixing the raw soil materials to obtain a mixed soil material having desired clay, sand and gravel contents; and (d) mixing metered amounts of the mixed soil material and at least one strength-enhancing additive in an automated manner so as to obtain the ready-mix soil material, wherein the method further includes, prior to stet (d), preparing ready-mix soil material formulations having different mechanical properties by varying amounts of the mixed soil material and said at least one strength-enhancing additive, and establishing a database for the ready-mix soil material formulations, and wherein the metered amounts in step (d) are determined with reference to the database.

10. The method as claimed in claim 9, further comprising, prior to step (c), analyzing samples of the raw soil materials in terms of the clay, sand, and gravel contents thereof.

11. The method as claimed in claim 9, wherein, in step (d), the mixed soil material is optionally further mixed with a suitable amount of water.

12. The method as claimed in claim 9, wherein the strength-enhancing additive used in step (d) is selected from the group consisting of a solidifying agent, a cementing agent, a water-reducing agent, and an early-strength agent.

13. A method for producing a ready-mix soil material comprising the steps of:

(a) crushing earth materials excavated from different work sites;

(b) sieving the earth materials after crushing so as to obtain different raw soil material;

(c) mixing the raw soil materials to obtain a mixed soil material having desired clay, sand and gravel contents; and (a mixing metered amounts of the mixed soil material and at least one strength-enhancing additive in an automated manner so as to obtain the ready-mix soil material, wherein crushing of the earth materials in step (a) is conducted after subjecting the earth materials to a drying treatment.

14. The method as claimed in claim 13, wherein the drying treatment includes exposing the earth materials to sunlight.

15. A method for producing a ready-mix soil material, comprising the steps of:

(a) crushing earth materials excavated from different work sites;

(b) sieving the earth materials after crushing so as to obtain different raw soil materials;

(c) mixing the raw soil materials to obtain a mixed soil material having desired clay, sand and gravel contents; and (d) mixing metered amounts of the mixed soil material and at least one strength-enhancing additive in an automated manner so as to obtain the ready-mix soil material, wherein, in step (c), the raw soil materials are optionally further mixed with at least one of an additive soil material having a high sand content, and an additive soil material having a high clay content.

16. A method for producing a ready-mix soil material, comprising the steps of:

(a) crushing earth materials excavated from different work sites;

(b) sieving the earth materials after crushing so as to obtain different raw soil materials;

(c) mixing the raw soil materials to obtain a mixed soil material having desired clay, sand and gravel contents; and (d) mixing metered amounts of the mixed soil material and at least one strength-enhancing additive in an automated manner so as to obtain the ready-mix soil material, wherein the mixed soil material is one of:

a material having a clay content of about 60 wt %, a sand content of about 40 wt %, and a gravel content less than 5 wt %;

a material having a clay content of about 40 wt %, a sand content of about 60 wt %, and a gravel content less than 5 wt %, and a material having a clay content of about 20 wt %, a sand content of about 80 wt % and a gravel content less than 10 wt %.

* * * * *